US008869972B2

(12) United States Patent
Shah

(10) Patent No.: US 8,869,972 B2
(45) Date of Patent: Oct. 28, 2014

(54) BIMATERIAL FLIGHT ASSEMBLY FOR AN ELEVATOR SYSTEM FOR A WHEEL TRACTOR SCRAPER

(75) Inventor: Ashish A. Shah, Decatur, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/570,456

(22) Filed: Aug. 9, 2012

(65) Prior Publication Data

US 2013/0043107 A1 Feb. 21, 2013

Related U.S. Application Data

(60) Provisional application No. 61/525,729, filed on Aug. 20, 2011.

(51) Int. Cl.
*B65G 17/32* (2006.01)
*E02F 3/65* (2006.01)

(52) U.S. Cl.
CPC ..... *E02F 3/655* (2013.01); *E20F 3/6481* (2013.01)
USPC ..... 198/714; 37/465

(58) Field of Classification Search
CPC ..... E02F 3/65
USPC ..... 198/714
See application file for complete search history.

(56) References Cited

U.S. PATENT DOCUMENTS

| | | | | |
|---|---|---|---|---|
| 3,415,712 | A | 12/1968 | Barker, Jr. | |
| 3,927,759 | A | 12/1975 | Hyler et al. | |
| 4,053,997 | A | 10/1977 | Stuller et al. | |
| 4,187,626 | A | 2/1980 | Greer et al. | |
| 4,286,705 | A | 9/1981 | Boersma | |
| 4,723,609 | A | 2/1988 | Curtis | |
| 5,224,555 | A | 7/1993 | Bain et al. | |
| 5,881,480 | A | 3/1999 | Fall | |
| 6,367,177 | B1 | 4/2002 | Mullen | |
| 6,571,493 | B2 | 6/2003 | Amano et al. | |
| 6,832,443 | B1 | 12/2004 | Piel et al. | |
| 6,857,208 | B2 * | 2/2005 | Gandhi et al. | 37/465 |
| 7,836,615 | B2 | 11/2010 | Winter | |
| 8,061,466 | B2 | 11/2011 | Carlton et al. | |
| 2004/0060208 | A1 * | 4/2004 | Wagner | 37/452 |
| 2004/0111926 | A1 | 6/2004 | Gandhi et al. | |
| 2007/0209241 | A1 | 9/2007 | Corrado et al. | |
| 2009/0314394 | A1 * | 12/2009 | Taulavuori et al. | 148/610 |
| 2010/0018728 | A1 | 1/2010 | Bright et al. | |
| 2010/0275473 | A1 * | 11/2010 | Maher | 37/453 |

FOREIGN PATENT DOCUMENTS

WO 2008045993 A2 4/2008

* cited by examiner

*Primary Examiner* — Ramya Burgess
*Assistant Examiner* — Thomas Randazzo
(74) *Attorney, Agent, or Firm* — Miller, Matthias & Hull

(57) ABSTRACT

An improved flight assembly for an elevator used with a wheel tractor scraper is provided. The flight assembly comprises a support member made of one type of material and an edge plate made of a second type of material that is harder and less flexible than the support member material. The edge plate is mounted to the support member and includes the cutting/digging edge of the flight assembly. In one embodiment the support member is made of a rolled steel material having a hardness of about 205 BHN and the edge plate is made of a hardened, heat treated steel material having a hardness of between about 360 BHN and about 440 BHN.

12 Claims, 4 Drawing Sheets

BIMATERIAL FLIGHT ASSEMBLY FOR AN ELEVATOR SYSTEM FOR A WHEEL TRACTOR SCRAPER

TECHNICAL FIELD

The present disclosure relates generally to a wheel tractor scraper and, more particularly, to an improved flight assembly for an elevator equipped wheel tractor scraper.

BACKGROUND

Wheel tractor scrapers used for earth and other material moving operations are sometimes equipped with an elevator system to assist in loading and spreading the material with little support equipment. The elevator lifts material off the cutting edge and carries it to the top of the elevator before dumping it into the scraper bowl.

The elevator comprises a series of flights attached to a pair of elevator chains. Elevator flights are a leading wear component of elevator equipped wheel tractor scrapers. The leading (contact) edge of the flight wears as a function of operating hours and the type of material being moved.

The present disclosure is directly at solving this problem.

SUMMARY OF THE DISCLOSURE

In accordance with one aspect of the present disclosure, there is provided a bimaterial flight assembly for an elevator used to carry material upwardly and rearwardly into a bowl of a wheel tractor scraper. The bimaterial flight assembly has a cutting edge that digs or cuts into the material and is susceptible to wear. The flight assembly comprises a support member and an edge plate mounted to the support member, the edge plate includes the cutting edge of the flight assembly. The support member is made of a first material and the edge plate is made of a second material that is harder and less flexible than the first material.

In another aspect of the disclosure a method of making a work tool for an off-highway machine is provided. The method comprises the steps of: providing a carrying component made of a first steel material; providing a working component having a cutting edge and made of a second steel material that is harder and less flexible than the first steel material; and affixing the working component to the carrying component.

DETAILED DESCRIPTION

While the subject matter of this disclosure may be embodied in many forms, there is shown in the figures and will herein be described in detail one or more embodiments, with the understanding that this disclosure is to be considered an exemplification of the principles of the subject matter and is not intended to limit the subject matter to the illustrated embodiments.

Figure 1:
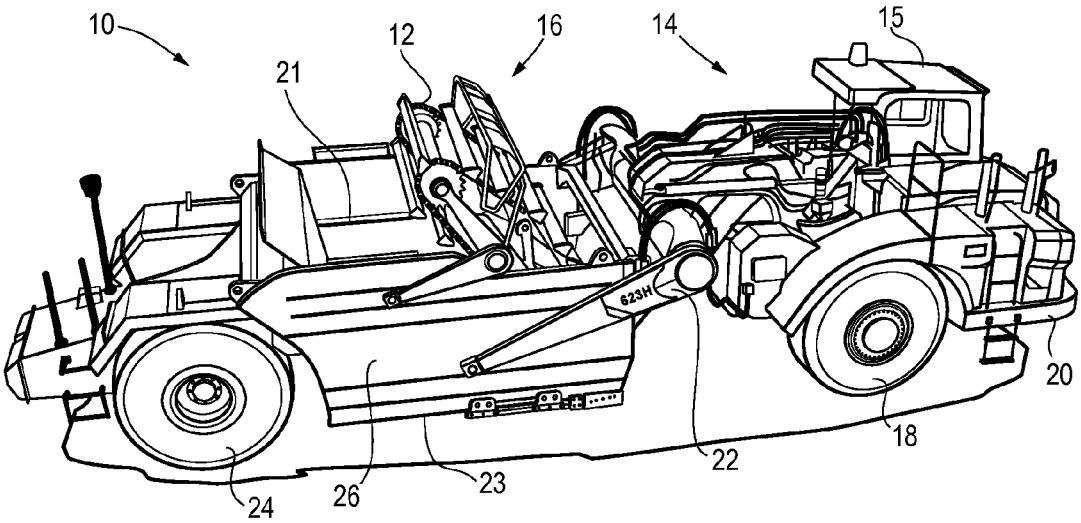
FIG. 1 is a perspective view of a wheel tractor scraper equipped with an elevator.

Turning to the drawings, there is shown in FIG. 1 a view of an exemplary wheel tractor scraper 10 having an elevator 12. The wheel tractor scraper 10 comprises a tractor portion 14 and a bowl portion 16. The tractor portion 14 comprises a cab or operator station 15, an engine or other power source 17, tractor wheels 18, a tractor frame 20 and a pair of rearwardly extending arms 22 which pivotally support the bowl portion 16.

The bowl portion 16 comprises a bowl 21 having sidewalls 26 and supported on a rear frame 23, a pair of wheels 24 and a moveable cutting plate (not shown) positioned between the sidewalls 26 underneath and near the forward end of the bowl portion 16. The elevator 12 is mounted onto the bowl portion 16 between the sidewalls 26 and carries material from the cutting plate upwardly and rearwardly into the bowl portion 16.

Figure 2:
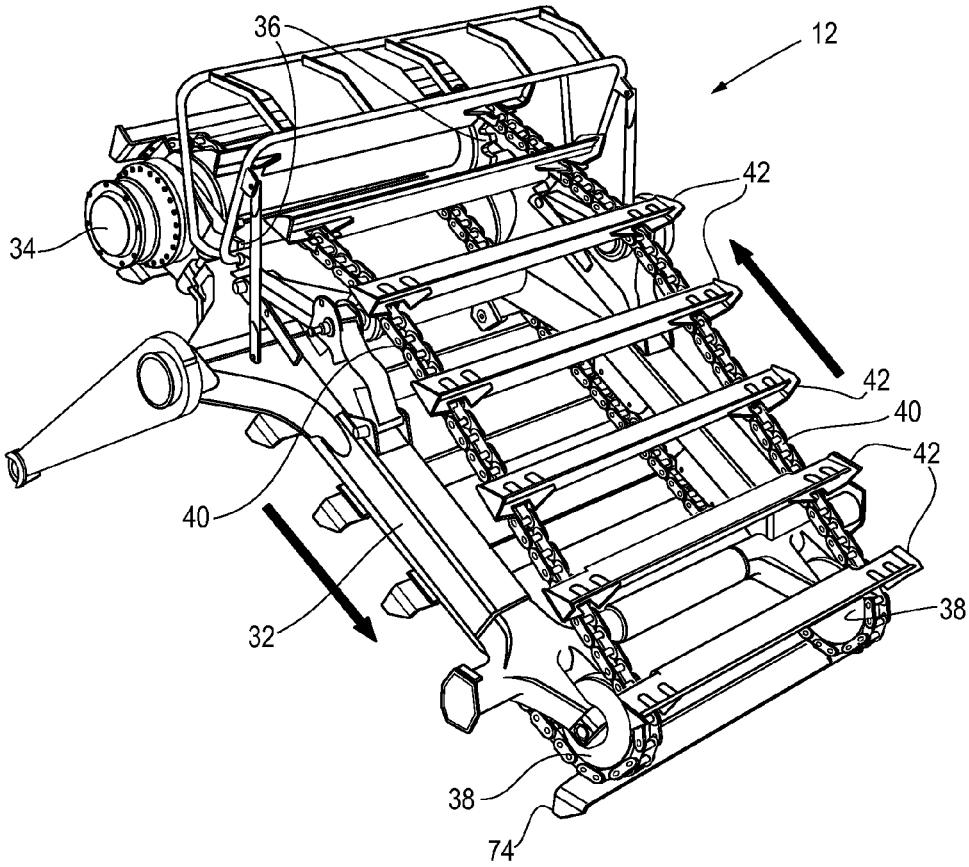
FIG. 2 is a perspective view of an elevator incorporating flight assemblies made according to the present disclosure.

As shown in FIG. 2, the elevator 12 comprises a frame 32 which attaches to the bowl sidewalls 26, a motor 34, sprockets 36 mounted at the upper end of the frame 32, guide wheels 38 mounted at the lower end of the elevator frame 32, a pair of chains 40 and a plurality of flight assemblies 42. The chains 40 are carried by the sprockets 36 and the guide wheels 38. The motor 34 drives the sprockets 36 which in turn drive the chains 40. The flight assemblies 42 are mounted at either end to the chains 40 in approximately evenly spaced relationship along the chains 40. The elevator chains 40, and thus the flight assemblies 42, rotate counterclockwise or clockwise as indicated by the arrows.

Figure 3:
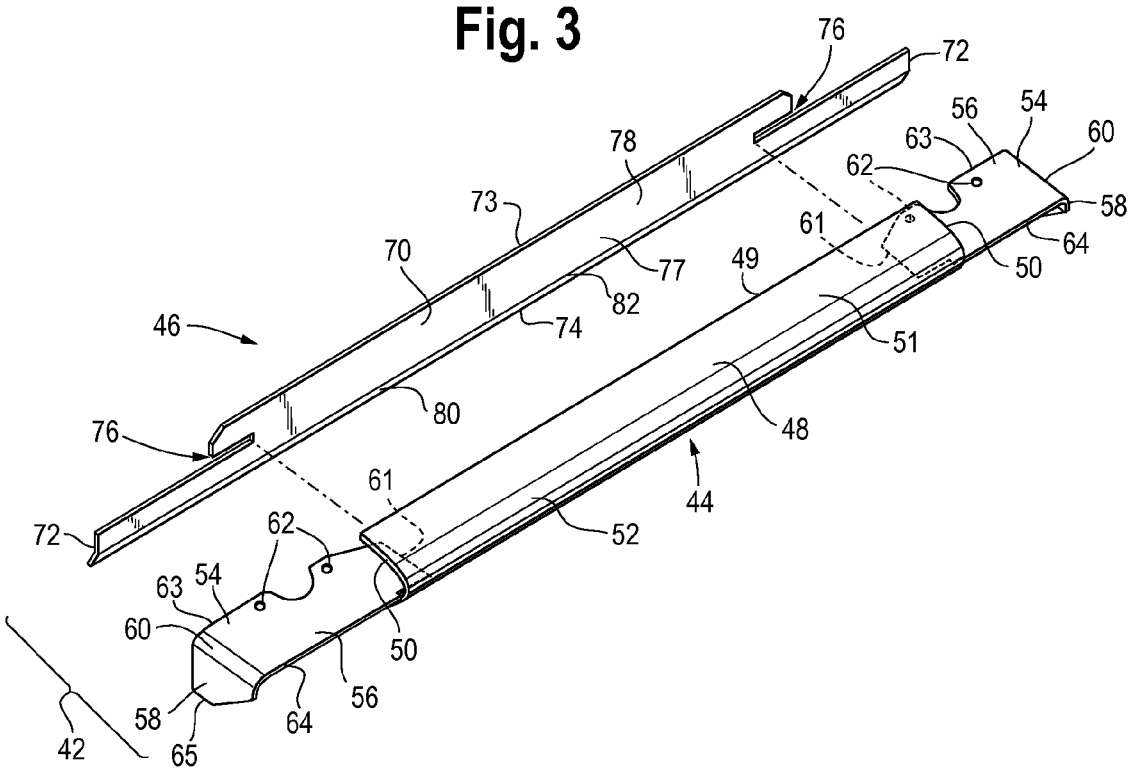
FIG. 3 is an exploded perspective view of one of the flight assemblies of FIG. 2.
Figure 4:
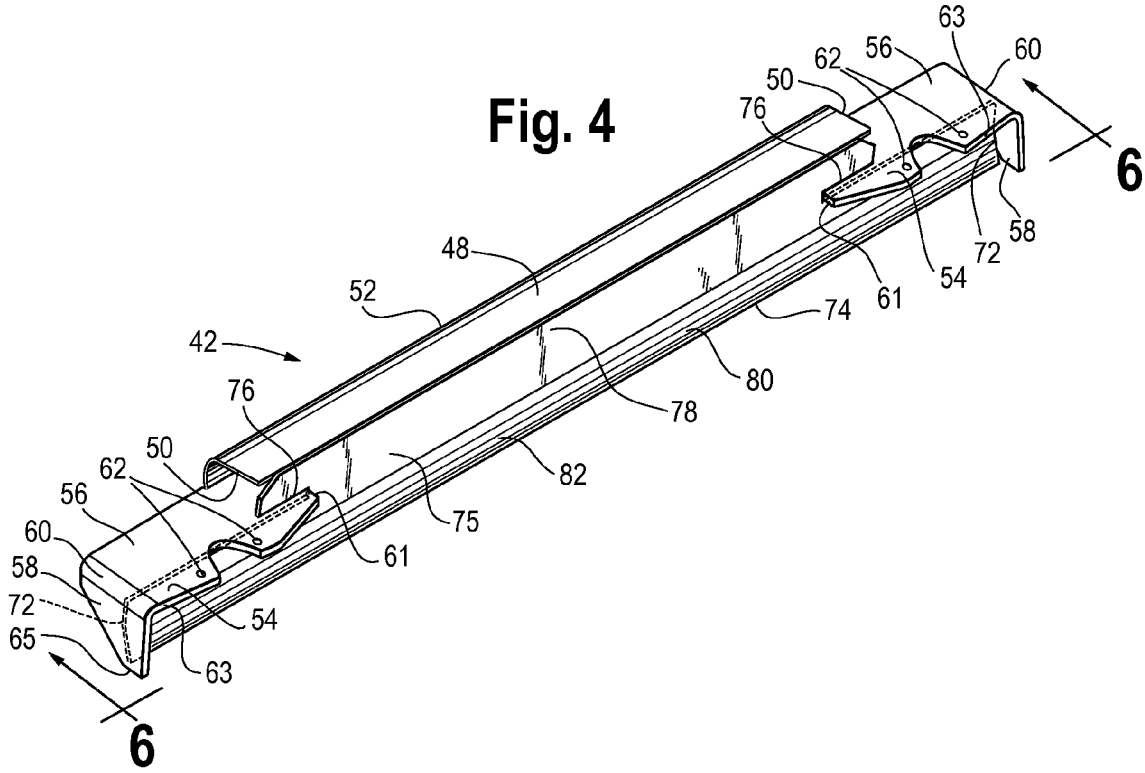
FIG. 4 is perspective view of a flight assembly according to the disclosure.

FIG. 3 is an exploded perspective view of a flight assembly 42 according to the present disclosure. The flight assembly 42 comprises a support member 44 and an edge plate 46. The edge plate 46 serves as the digging component of the flight assembly 12 and is carried on the support member 44. The support member 44 carries an attachment plate or bracket member 56 on either end for mounting the flight assembly 12 to the elevator chains 40. The edge plate 46 may be welded or otherwise affixed to the support member 44.

FIGS. 4-7 provide various views of an assembled flight assembly 42. The geometries of the support member 44 and the edge plate 46 are designed to provide adequate stiffness to the flight assembly 12. The materials of construction are selected to provide toughness while reducing the tendency of the edge plate 46 to brittle failure.

Figure 5:
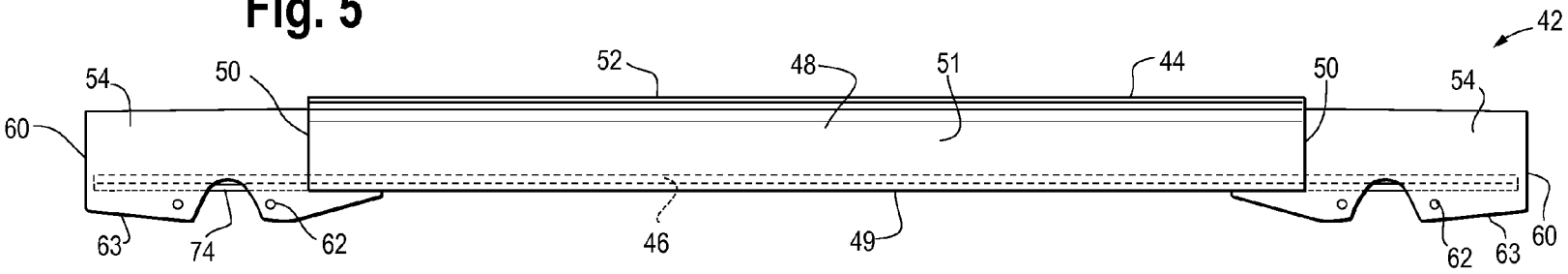
FIG. 5 is a top view of the flight assembly of FIG. 4.

As shown in the figures, the support member 44 comprises an elongated body portion 48 having an asymmetrical, U-shaped side profile with a substantially flat, elongated top section 51 and a substantially flat, elongated bottom section 53 connected along a curved rear edge 52. As shown in FIG. 5 the top section 51 has a length extending from one end 50 to an opposing end 50 and a width extending rearward from a front edge 49 to the rear edge 52. The rear edge 52 has a length and extends from one end 50 to the opposing end 50. The bottom section 53 has a length and extends from one end 50 to the opposing end 50 and a width extending rearward from a forward edge 55 (FIG. 7) to the rear edge 52.

Substantially L-shaped left and right hand bracket members 54 are affixed to the opposing ends 50 of the support member 44 and are used to attach the flight assembly 42 to the elevator chains 40. Each bracket member 54 has a substantially L-shaped profile when viewed from the front—see FIGS. 3 and 6—or rear—see FIG. 3—and comprises a top plate 56 and a sidewall 58 joined to the top plate 56 along an outer edge 60 and extending downwardly therefrom at substantially a right angle to the top plate 56 to create the L-shape. Each bracket member 54 has a front edge 63 and a rear edge 64. The top plate 56 may be somewhat elongated and has a length extending from an inner edge 61 to the outer edge 60 and a width extending from the front edge 63 to the rear edge 64. In the illustrated embodiment, each sidewall 58 has a somewhat irregular shape and has a height extending from the outer edge 60 downward to a substantially parallel but shorter bottom edge 65 and a width extending from the front edge 63 to the rear edge 64. Each bracket member 54 may include openings 62 formed in the top plate 56 to receive fasteners (not shown) for affixing the flight assembly 42 to the chains 40.

Figure 6:
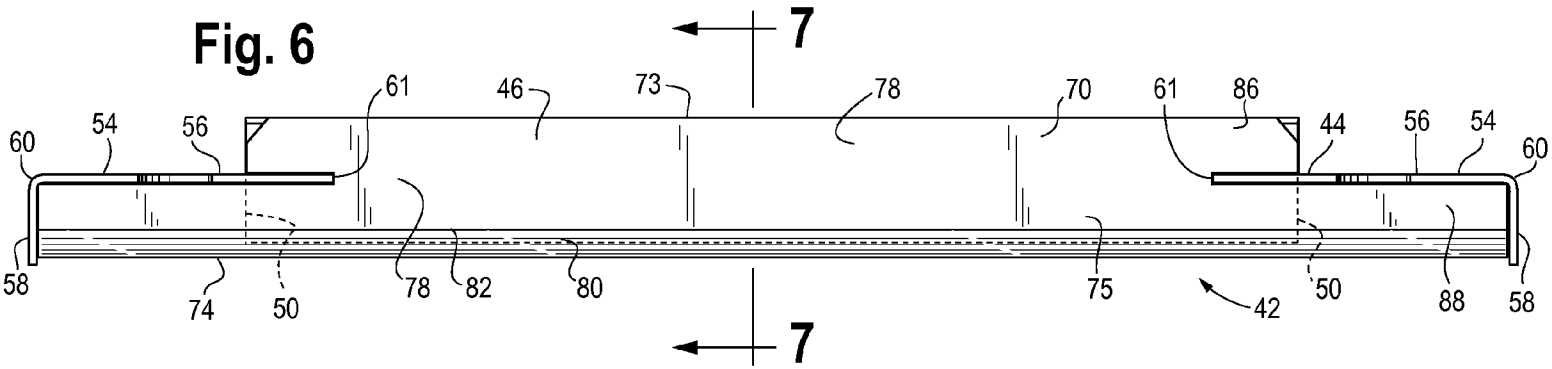
FIG. 6 is a front view of the flight assembly of FIG. 4 from the viewpoint of line 6-6.
Figure 7:
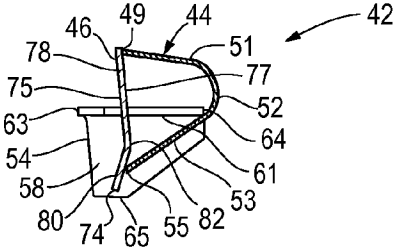
FIG. 7 is a cross-sectional view of the flight assembly of FIG. 6 taken along line 7-7.

Each bracket member 54 is affixed to and extends outwardly from an end 50 of the support member 44. Referring to FIG. 7, a portion of the rear edge 64 of each bracket member 54 may abut the curved rear edge 52 of the body portion 48 and be affixed thereto by welding or other means. The bracket members 54 may also be welded to the edge plate 46 to form a strong, unitary construction. In the assembled flight assembly 42, the front edge 63 of each bracket member 54 may extend forward (in front of) of the top section front edge 49 and bottom section forward edge 55 of the support member 44 as shown in FIG. 7. As best shown in FIG. 6, each bracket member inner edge 61 may extend inwardly from the respective bracket member end 50.

Figure 8:
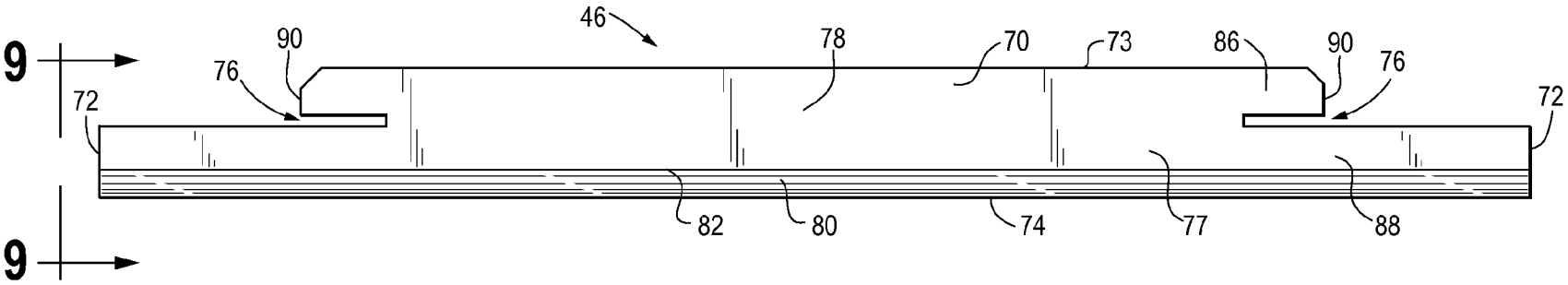
FIG. 8 is a rear view of an edge plate.
Figure 9:
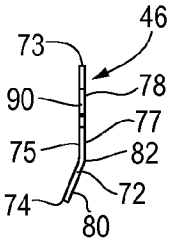
FIG. 9 is a left side elevational view of the edge plate of FIG. 8 from the viewpoint of line 9-9.

FIG. 8 is a rear view and FIG. 9 is a side view of an edge plate 46. The edge plate 46 comprises an elongated body 70 having opposing ends 72, a top edge 73 and a digging or contact edge 74. The edge plate 46 further comprises a front (forward facing) side 75 and a rear side 77. As best shown in FIG. 9, the body 70 comprises an elongated, substantially planar upper portion 78 and an elongated, substantially planar lower portion 80 joined along a longitudinal bend or crease 82 and defining an obtuse included angle when viewed from the side. As best shown in FIG. 8, the upper portion 78, i.e., the portion of the edge plate 46 above the crease 82, comprises a relatively wide section 88 and a coplanar but relatively narrow section 86 extending upward from the wide section 88 away from the crease 82.

The narrow section 86 of the edge plate 42 is partially separated from the wide section 88 by a pair of horizontal slots 76 cut into or otherwise formed in the edge plate 46. As explained further below, the slots 76 are configured to receive the bracket members 54 when the flight assembly 42 is assembled. The narrow section 86 has first opposing ends 90, while the wide section 88 has second opposing ends 72. The width of the narrow section 86 may be determined by, and preferably is about the same as, the width of the front edge 49 of the support member 44.

The edge plate 46 may be welded to the support member 44 or otherwise affixed thereto by any suitable means. For example, as best shown in FIG. 7, when a flight 42 is assembled, the rear side 77 of the edge plate 46 is positioned against the support member 44, with the upper portion 78 of the edge plate 46 abutting the forward edge 49 of the top section 51 of the support member 44 and the lower portion 80 of the edge plate 46 abutting at least part of the forward edge 55 of the bottom section 53 of the support member 44. Thus the edge plate 46 may be welded or otherwise affixed to the support member 44 along two substantially parallel edges 49, 55.

In the assembled flight assembly 12, the top plate 56 of each bracket member 54 extends through one of the slots 76 in the edge plate 44 and may contact the edge plate 44 along the surfaces around the slot 76. The edge plate 46 may be affixed to the top plate 56 along these areas of contact, thereby providing two more areas where the edge plate 46 can be secured to the support member 44.

The materials of construction of the flight assembly 42 are selected to provide overall toughness while reducing the tendency of the edge plate 46 to brittle failure. Together as a combined flight assembly 12, the edge plate 46 and the support member 44 provide improved wear resistance without reducing impact resistance.

Preferably the support member is made of a first material, and the edge plate 46 is made of a second material that is harder and less flexible than the first material used to make the support member 44, because the edge plate 46 is subject to greater frictional forces, impact forces and other stresses than the support member 44.

More preferably, both the edge plate 46 and the support member 44 are made of steel materials, with the edge plate steel material being harder and less flexible than the support plate steel material.

Still more preferably, the edge plate 46 is made of hardened, heat treated steel and the support member 44 is made of rolled steel.

For example, the edge plate 46 may be made of hardened, tempered quenched steel with a hardness of between about 360 BHN and 440 BHN and a compressive yield strength of between about 900 MPa (megapascals) and 1100 MPa. The support member may be made of a softer, rolled steel with a hardness of about 205 BHN and a compressive yield strength of about 500 MPa.

In another aspect of the invention, a method of making a work tool for an off-highway machine is provided. The method comprises the steps of: providing a carrying component made of a first steel material; providing a working component having a digging or cutting surface or edge and made of a second steel material that is harder and less flexible than the first steel material; and affixing the working component to the carrying component. The first steel material may be rolled steel. The second steel material may be a hardened, heat treated steel.

The off-highway machine may be a wheel tractor scraper or other machine. The work tool may be a flight assembly for an elevator or other work tool. The working component may be an edge plate of the kind described above. The carrying component may be a support member of the kind described above.

INDUSTRIAL APPLICABILITY

The flight assembly of the present disclosure finds general applicability with any elevator flight system for wheel tractor scrapers and other machines. The flight assembly improves the flight durability by using a harder material of construction in the leading edge plate and a less hard and more flexible material for the support member or back plate. The flight assembly improves wear resistance without reducing impact resistance.

It is understood that the embodiments of the disclosure described above are only particular examples which serve to illustrate the principles of the disclosure. Modifications and alternative embodiments of the disclosure are contemplated which do not depart from the scope of the disclosure as defined by the foregoing teachings and appended claims. It is intended that the claims cover all such modifications and alternative embodiments that fall within their scope.

The invention claimed is:

1. A bimaterial flight assembly for an elevator used to carry material upwardly and rearwardly into a bowl of a wheel tractor scraper, the bimaterial flight assembly having a contact edge that cuts into the material and is susceptible to wear, the flight assembly comprising:

a support member comprising an elongated body portion having an asymmetrical U-shaped side profile, the support member made of a first material, wherein said support member includes left and right hand bracket members affixed to opposing ends; and an edge plate mounted to the support member, the edge plate including an elongated, substantially planar upper portion and an elongated substantially planar lower portion including the contact edge of the flight assembly, joined along a longitudinal bend and defining an obtuse included angle, the edge plate being made of a second material that is harder and less flexible than the first material.

2. The bimaterial flight assembly of claim 1 wherein:

said edge plate includes a narrow section that is partially separated from a wide section by a pair of horizontal slots formed in said edge plate;

wherein said slots are configured to receive the bracket members when said flight assembly is assembled.

3. The bimaterial flight assembly of claim 1 wherein:

the support member is made of a first steel material; and the edge plate is made of a second steel material that is harder and less flexible than the first steel material.

4. The bimaterial flight assembly of claim 3 wherein:

the support member is made of a rolled steel material; and the edge plate is made of a hardened, tempered quenched steel material that is harder and less flexible than the support member steel material.

5. The bimaterial flight assembly of claim 4 wherein:

the edge plate is made of hardened, tempered quenched steel with a hardness of between about 360 BHN and 440 BHN and a compressive yield strength of between about 900 MPa and 1100 MPa; and the support member is made of rolled steel with a hardness of about 205 BHN and a compressive yield strength of about 500 MPa.

6. The bimaterial flight assembly of claim 4 wherein:

the support member comprises an elongated body portion having an asymmetrical, U-shaped side profile, the body portion comprising a substantially flat, elongated top section and a substantially flat, elongated bottom section connected along a curved rear edge;

the edge plate comprises an elongated body having opposing ends, a top edge, a cutting edge, a front side and a rear side.

7. The bimaterial flight assembly of claim 6 wherein:

the top section of the support member extends from a front edge to the curved rear edge and the bottom section of the support member extends from a forward edge to the curved rear edge; and the edge plate further comprises an elongated, substantially planar upper portion and an elongated, substantially planar lower portion joined along a longitudinal bend.

8. The bimaterial flight assembly of claim 7 wherein:

the rear side of the edge plate is positioned against the support member so that the upper portion of the edge plate abuts the front edge of the top section of the support member and the lower portion of the edge plate abuts at least part of the forward edge of the bottom section of the support member.

9. The bimaterial flight assembly of claim 7 wherein:

the edge plate is welded to the support member along the support member's front edge and forward edge.

10. A method of making a work tool for an off-highway machine comprising the steps of:

providing a carrying component comprising an elongated body portion having an asymmetrical U-shaped side profile, the carrying component made of a first steel material;

providing a working component having an elongated, substantially planar upper portion and an elongated substantially planar lower portion including a cutting edge and joined along a longitudinal bend and defining an obtuse included angle, the working component made of a second steel material that is harder and less flexible than the first steel material; and affixing the working component to the carrying component.

11. The method of claim 10 wherein:

the first steel material is rolled steel; and the second steel material is hardened, heat treated steel.

12. The method of claim 10 wherein:

the off-highway machine is a wheel tractor scraper;

the work tool is a flight assembly for an elevator;

the working component is an edge plate; and the carrying component is a support member on which the edge plate is mounted.

* * * * *